US006060007A

United States Patent [19]

Hutton et al.

[11] Patent Number: 6,060,007

[45] Date of Patent: May 9, 2000

[54] PROCESS FOR FORMING DYED BRAIDED SUTURE

[75] Inventors: Jeffrey D. Hutton, Southbury; Barry L. Dumican, Newtown, both of Conn.

[73] Assignee: Tyco Group S.A.R.L., Luxembourg, Luxembourg

[21] Appl. No.: 09/175,324

[22] Filed: Oct. 20, 1998

[51] Int. Cl.[7] ..... D01F 1/06; D02G 3/00

[52] U.S. Cl. ..... 264/78; 8/489; 8/497; 8/675; 264/103; 264/210.8; 264/211; 264/211.12; 264/211.14; 264/280; 264/341

[58] Field of Search ..... 264/78, 103, 210.8, 264/211, 211.12, 211.14, 280, 341; 8/489, 497, 675

[56] References Cited

U.S. PATENT DOCUMENTS

| | | | |
|---|---|---|---|
| 3,527,556 | 9/1970 | Riley . | |
| 3,807,273 | 4/1974 | Kurtz et al. | 87/1 |
| 4,008,303 | 2/1977 | Glick et al. | 264/78 |
| 4,141,881 | 2/1979 | Babler . | |
| 4,176,113 | 11/1979 | Wick et al. . | |
| 4,279,802 | 7/1981 | Laley et al. . | |
| 5,019,093 | 5/1991 | Kaplan et al. | 606/228 |

FOREIGN PATENT DOCUMENTS

| | | |
|---|---|---|
| 2027751 | 1/1972 | Germany . |
| 2334064 | 1/1974 | Germany . |
| 59-125983 | 7/1984 | Japan . |
| 668555 | 1/1989 | Switzerland . |
| 1279048 | 6/1972 | United Kingdom . |
| 1317190 | 5/1973 | United Kingdom . |
| 1317281 | 6/1973 | United Kingdom . |
| 1320563 | 6/1973 | United Kingdom . |

*Primary Examiner*—Leo B. Tentoni
*Attorney, Agent, or Firm*—Fitzpatrick, Cella, Harper & Scinto

[57] ABSTRACT

A dyed braided suture is formed by dry blending a colorant and a thermoplastic resin; extruding the blend by melt spinning to form filaments; drawing the filaments, braiding the drawn filaments and converting the braided filaments to a suture.

17 Claims, 2 Drawing Sheets

PROCESS FOR FORMING DYED BRAIDED SUTURE

BACKGROUND OF THE INVENTION

1. Field of the Invention

This invention relates to a process for forming dyed braided sutures.

2. Description of Related Art

Braided sutures are well known in the art as disclosed, for example in U.S. Pat. No. 5,019,093. Various natural and artificial polymeric materials have been used in manufacture of braided sutures, including surgical gut, silk, cotton, polyolefins, polyamides, polyglycolic acid and polyesters. Braided sutures are useful in applications where a strong, nonabsorbable suture is needed to permanently repair tissue. They are frequently used in cardiovascular surgery, as well as in ophthalmic and neurological procedures.

For various reason it is desirable to provide sutures which are dyed. For example, dyed sutures allow immediate suture brand and/or type recognition by the surgical team or treating physician as well as enhancing visibility of the suture in the surgical field. Previously, braided sutures were formed from braided yarns of thermoplastic, non-absorbable polymer which were textile dyed. The braided yarns had a reduced tenacity because it was easier to dye a less crystalline matrix. Thereafter, the dyed braids were stretched to increase their tenacity and to make the yarn more crystalline. However, braided yarns are not dyed thoroughly by conventional solution dyeing techniques even at such a lower tenacity. The braided yarns tended to resist uniform penetration by dye solutions. In particular, this is true of polyethylene terepthalate non-absorbable sutures.

More recently, higher molecular weight polyester fibers formed from polyethylene terephthalate have been employed as suture material. Such fibers have a relatively high initial tenacity and a relatively high intrinsic viscosity. It has proven necessary to dye such fibers by boiling the fibers in a dye solution. Even then, there is relatively low penetration of dye into the fibers. To obtain thorough dye uptake by the polyester fibers it has usually proven necessary to apply the dye solution at conditions of high pressure and high temperature. At such elevated pressures and temperatures, however, both the dye and fiber can be degraded.

Accordingly, it is desired to provide a method for incorporating dye uniformly into a suture material free of the defects and deficiencies of the prior art.

BRIEF SUMMARY OF THE INVENTION

These and other objects and advantages are achieved by forming a dyed braided suture by:

(a) blending a biocompatible colorant with an extrudable non-bioabsorbable thermoplastic resin to form a uniform blend of said colorant and resin;

(b) extruding the blend by melt spinning and cooling to form filaments;

(c) drawing the filaments to increase crystallinity and molecular orientation;

(d) braiding the drawn filaments; and (e) converting the braided filaments into a suture.

Bulk thermoplastic resin can be thoroughly dry blended with an FDA-approved dye powder to uniformly disperse the dye in the bulk resin prior to extrusion.

DETAILED DESCRIPTION OF THE INVENTION

Figure 1:
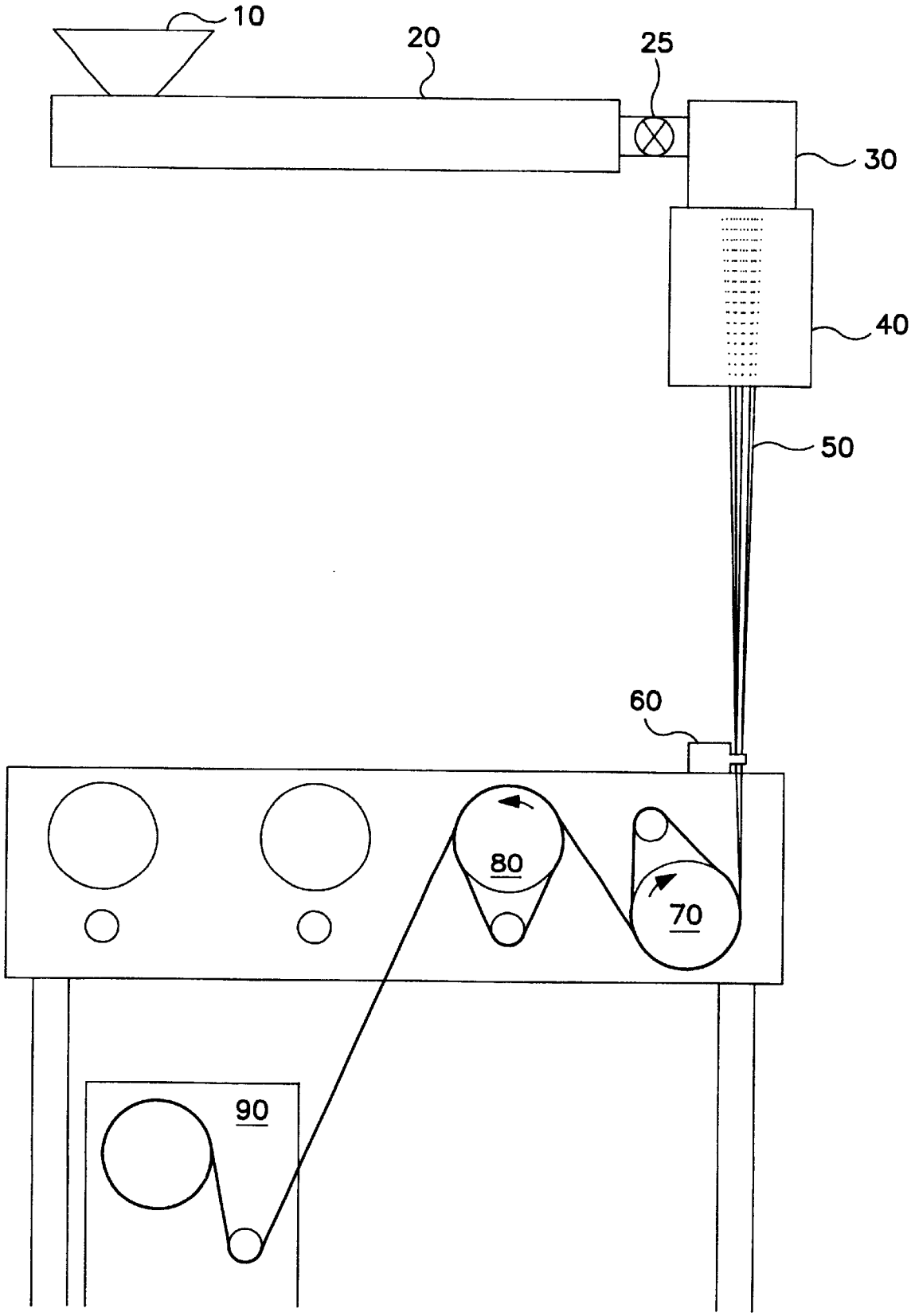
FIG. 1 is a plan view of a system for extruding dyed polyester filaments from a blend of dye and bulk resin.

The dyed braided sutures of this invention are manufactured from yarn filaments produced from thermoplastic resins having an intrinsic viscosity preferably greater than about 0.95.

The thermoplastic resin employed is extrudable and non-bioabsorbable. Suitable thermoplastic resins include homo- and copolymers of dyeable $C_1$–$C_6$ olefins, polyamides and polyesters of difunctional carboxylic acids and diols. Typical $C_1$–$C_6$ olefinic polymers include polyethylene, polypropylene and copolymers thereof. Preferably, the thermoplastic resin employed in this invention is polyethylene terephthalate (PET).

Bulk resin can be employed in any suitable form including granules, chips or pellets. Bulk PET with suitable properties may be obtained commercially from, for example, Shell Chemical Co., Apple Grove, West Va. distributed under the designation Cleartuf EB 1040 and Traytuf 106C and DSM Engineering Plastics, Evansville, Ind. under the designation Arnite A06 100.

The colorant employed to dye the suture is preferably a free-flowing dye or pigment powder at room temperature. The preferred dye is non-reactive and biologically inert. The dye is preferably an FDA-approved dye which may be an appropriate color, preferably blue or green. Typical dyes employable in medical devices, including sutures, include Color Index (C.I.) No. 74160-[phthalocyannato (2-)] copper; C.I. No. 61565-D&C Green No. 6 and C.I. No. 60725-D&C Violet No. 2. A preferred dye is C.I. No. 73000- D&C Blue No. 6 [$\Delta^{2,2'}$-biindoline]-3,3'-dione.

In general, to conduct the blending step the dye is dry dispersed into the bulk form of the thermoplastic resin prior to extruding. In one aspect the dye powder is added to bulk form resin in pellet, granule or chip form and dry blended in, for example, a rotating blender or Abbey blender for a sufficient time to form a uniform dispersed blend. In general, such dry blending may be conducted for from about 1 to 2 minutes.

The blend of dye and thermoplastic resin should be dry prior to extruding. Any water present in the blend will tend to cleave polymer chains at extrusion temperatures. The blend may be dried, for example, in desiccated hot air at 155° C. for at least eight hours, to remove trace moisture and any volatiles present.

Generally, sufficient colorant is employed in the blend to dye the resin to a desired target coloration. To achieve an appropriate shade of color the colorant is preferably employed in amounts up to about 0.2% by weight, based on the total weight of colorant and resin, more preferably from about 0.01 to about 0.2% by weight, more preferably from about 0.05 to 0.1% by weight and, most preferably, at about 0.075% by weight, although higher or lower amounts can be utilized, if desired. Generally, a deep shade of color is desirable for enhanced visibility and recognition. All weights are based on the total weight of the blend, unless otherwise provided.

The dry blend of resin and colorant is then extruded by melt spinning and cooling to form filaments. Conventional techniques to form yarn filaments are well known in this art and are applicable. Typically, the blend is heated and softened in an extruder and is then introduced into a spinnerette having a plurality of holes to form yarn filaments. A spin finish may be applied to lubricate the filaments. Typically, a light mineral oil, sorbitan monolaurate (SPAN-20) or another appropriate surfactant or oil may be so utilized. The yarn filaments are taken up in a precision winder. The yarn properties at this stage are typically:

Denier: 20–500, preferably 20–375

Tenacity: 1–1.5 gm/d

Elongation to break: 500–600%

After a typical hold time of from about eight (8) hours to three (3) months, preferably 48 hours, the filaments are drawn employing conventional rotating godets. Typically, three godets are employed—the first maintained at a near ambient temperatures, the second maintained at from about 70° to about 110° C. and the third maintained at from about 150° to about 210° C. The filaments are typically stretched on the order of at least 4 to 6 times their original extruded length. Drawing increases the crystallinity and orientation of the filaments to enhance strength. The drawn filaments may be entangled or twisted to interlace the filaments and give cohesion to the resulting yarn. An air-jet entangler may be employed after the drawn filaments exit the last godet for that purpose. If desired, the flat yarn may be collected at a winder and twisted thereafter.

In one embodiment twisted yarns can be braided into sutures using conventional braid constructions having a sheath and optionally a core.

Typical braid constructions are disclosed in U.S. Pat. No. 5,019,093, issued May 28, 1991, the disclosure of which is incorporated herein by reference. In one embodiment, the drawn and entangled yarn is two-plied at 3 turns/inch (tpi) half in the "S" direction and half in the "Z" direction. The two-plied yarns are parallel wound onto braider bobbins. The braid is preferably made on an eight carrier braider; four carriers travelling clockwise being loaded with yarns having the "Z" twist and the remaining four carriers traveling counter-clockwise being loaded with yarns having "S" twist.

Typical braid constructions have the parameters recited in Table 1 are as follows:

TABLE 1

Braid Constructions

| Suture Size | No. of Sleeve Yarns | Sleeve Yarns (denier/filament) | Corn Yarn (denier/filament) | Picks/ Inch |
|---|---|---|---|---|
| 5 | 16 | 250/50 | 1000/200 | 52 |
| 2 | 16 | 140/68 | 840/408 | 57 |
| 1 | 12 | 140/68 | 630/306 | 52 |
| 0 | 12 | 100/34 | 300/102 | 42 |
| 2–0 | 8 | 140/68 | None | 39 |
| 3–0 | 8 | 80/16 | None | 39 |
| 4–0 | 4 | 70/34 | None | 39 |
| | 4 | 40/8 | | |
| 5–0 | 8 | 30/20 | None | 33 |
| 6–0 | 4 | 30/20 | None | 32 |
| | 4 | 20/10 | | |
| 7–0 | 3 | 20/10 | None | 67 |

After the braids have been assembled, they are preferably washed to remove any processing finish, dirt and/or contaminants introduced as a result of braiding. Thereafter, the washed braid is preferably stretched in the presence of heat. Preferably, the temperature range for such stretching is from about 150° C. to about 250° C. Typically, during such stretching the length of the braided sutures increases by about 6% to about 33% of their original length.

Typical stretching is conducted in accordance with conventional techniques known to this art. The braid may be conducted to a stretching chamber over a heated input roller, stretched in the chamber at a desired tension, i.e., about 2100 grams for a size of braid having an unstretched denier of 1540, for example, and at elevated temperatures and conducted from the chamber via a heated output roller.

During the stretching operation the braid can also be passed under a matte roller, or the like, where the heat and tension impart a slight roughness to the braid surface. Without such treatment to roughen the surface of the stretched braids, the stretched braid can sometimes be unduly smooth. An unduly smooth suture surface can make it difficult to grasp the suture and tie a desired knot. Also, stretching can significantly stiffen the braid imparting undesirable handling properties to the suture. In order to allow better control of the suture during tying it is preferred to conduct additional processing of the suture to provide additional appropriate surface roughness and lessen fiber stiffness to allow the surgeon to have better feel of the suture and permit easier knotting.

To further enhance the feel of the suture, the stretched braid may be surface-etched to break any adhesions present on the braid surface and to soften the braid. Such etching is conducted by exposing the braid to a solution such as sodium hydroxide or the like. The surface etching and the above-noted matte roller treatments can further improve the surface feel of the braid to facilitate knot tying.

Optionally, the braided polyester sutures are treated with a coating material to impart improved handling to the treated braid. The preferred coating material is silastic rubber. Other coating materials would include polytetrafluoro ethylene, PTFE, or polybutilate.

The braid is then converted into a suture by attaching a needle, packaging the product and then sterilizing with ionizing radiation, ethylene oxide or the like.

The filaments in the final suture product may have a molecular weight less than the molecular weight of the original polymer. It is believed that the sterilizing treatment, heating and/or stretching treatments conducted during processing of the filaments into a suture may break polymer chains and reduce molecular weight.

The improved dyed sutures of this invention, as compared to commercially available sutures, have significantly improved tensile strength.

In another embodiment of this invention, the dyed polyester yarns are used in providing an implantable medical device. Examples of such a device is a mesh, a graft, a ligament replacement and a tendon replacement. A mesh, or net formed from polyester yarns is typically used in surgical repair of hernias. The enhanced tenacity of the dyed polyester yarns of this invention provides the mesh with superior strength. A graft is a knitted or woven tubular article used in replacement of blood vessels. The enhanced tenacity of the polyester yarns of this invention allows construction of a graft with thinner walls and greater flexibility. Ligament and tendon replacements comprise multiple strands of polyester yarns that have been braided, for which the yarns of the present invention provide superior strength.

The dyed braided suture may be formed from yarn filaments having a weight average molecular weight of greater than 35,000, a tenacity of greater than about 6 grams/denier, an elongation to break less than about 35% and a boiling water shrinkage from about 0.5 to about 2.0%. The filaments typically have a weight average molecular weight preferably greater than 40,000 and, most preferably, from about 42,000 to 45,000. The tenacity of the filaments is preferably greater than 7 grams/denier. In general the tenacity can be on the order of at least about 11.0 grams/denier. The percent elongation to break is preferably less than 25%, most preferably less than 20%. The filaments may have a hot air shrinkage at 350° C. from about 3 to 5% of the original length.

The filaments are typically extruded in bundles (yarns) having a denier from about 20 to about 500 and may be twisted in this step or subsequently. If desired the yarns may be entangled and processed without twisting. If twisted, the yarns typically have from 0.1 to 15 turns per inch (tpi).

The examples which follow are intended to illustrate certain preferred embodiments of the invention, and no limitation of the invention is implied.

EXAMPLE 1

Extrusion of PET Yarn Filaments

A PET yarn extrusion system employed in the invention is illustrated in FIG. 1. Bulk PET resin chips were admixed with 0.075% by weight of D&C Blue No. 6 and dry blended for from about one (1) minute to two (2) minutes in a large plastic bag. The blend of bulk PET resin (type TTF 1006C,—initial viscosity 1.04—available from Shell Chemical Co.) and dye was dried overnight in an oven at 110–130° C. under a vacuum of less than 2 Torr. The oven was brought to atmospheric pressure with dry air. The dried resin blend was transferred to feed hopper 10 of the extrusion system and introduced into extruder barrel 20 which is 0.75 inches in diameter and 15 inches long via an extrusion screw (not shown). The extruder barrel contained three heating zones (or extrusion zones)—zones 1, 2 and 3. The heated and softened resin from the extruder was fed into a metering pump (melt pump) 25, and from melt pump 25 the extruded resin was fed into spin head 30.

Spin head 30 houses a spin pack comprising filtering media (screens) and a spinnerette containing from 16 to 35 holes (not shown) for forming the individual filaments of the yarn. The extruded filaments 50 exited the spinnerette through hot collar 40, and were then air-cooled until they solidified. The resulting dyed yarn was then passed through a finish applicator 60, over two rotating godets 70 and 80, and was collected on precision winder 90 as the yarn exited the second godet 80. The denier of the yarn at this point was 354.

The operating parameters for the extrusion system are shown in Table 2.

TABLE 2

| Station | Units | Value |
|---|---|---|
| Extrusion Screw | Rotations/Minute | 42 |
| Extrusion Zone 1 | Temperature ° C. | 320 |
| Extrusion Zone 2 | Temperature ° C. | 320 |
| Extrusion Zone 3 | Temperature ° C. | 320 |
| Melt Pump 25 | Temperature ° C. | 310 |
| Melt Pump Size | cc/Revolution | 0.584 |
| Melt Pump Rate | Rotations/Minute | 25.9 |
| Spin Pack Pressure | Pounds/Sq. Inch | 2764 |
| Spinnerette | Number of Holes | 28 |
| Spinnerette Hole Diameter | Mils | 10 |
| Hot Collar 40 | Temperature ° C. | 250 |
| First Godet 70 | Temperature ° C. | Ambient |
| First Godet 70 | Surface Speed (fpm) | 1500 |
| Second Godet 80 | Temperature ° C. | Ambient |
| Second Godet 80 | Surface Speed (fpm) | 1507 |

EXAMPLE 2

Drawing of Yarn Extruded in Example 1

Figure 2:
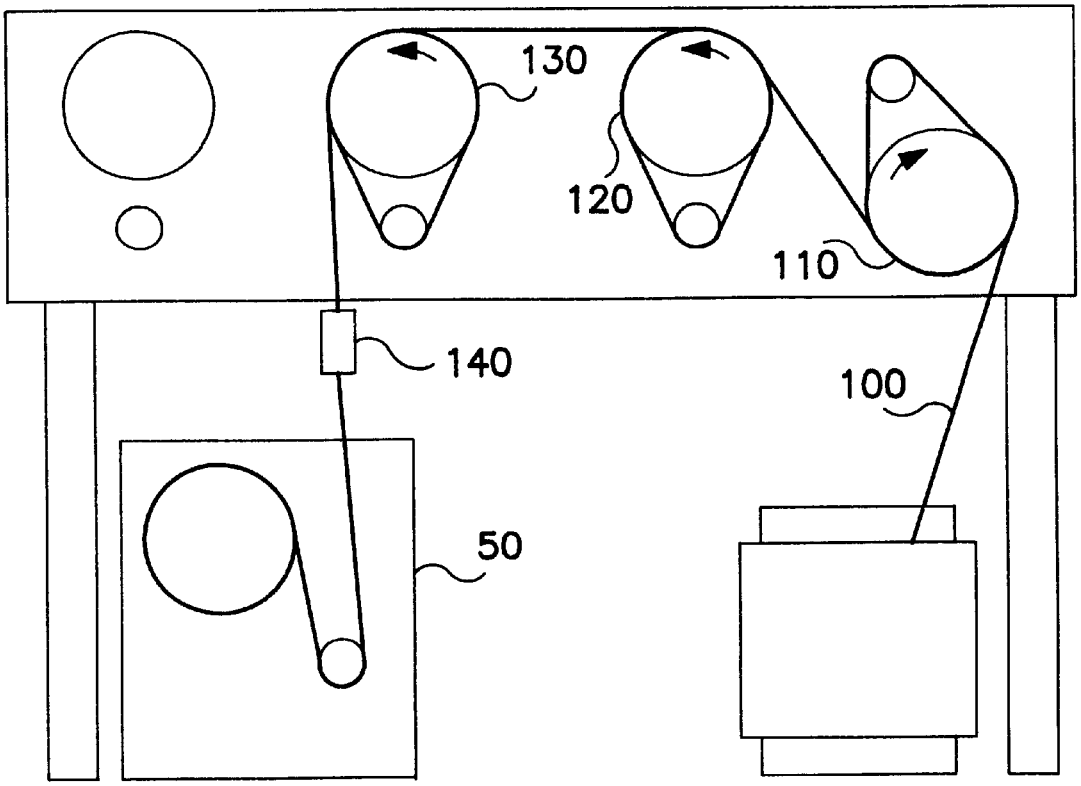
FIG. 2 is a plan view of a system for drawing the dyed polyester filaments.

After a six-day lag time the yarn extruded in Example 1 was drawn. Drawing was conducted by passing the extruded yarn 100 around multiple rotating rolls, as illustrated in FIG. 2. The drawing action was initiated by passing yarn 100 first over a roll (godet) 110 having a first, lower rotational speed and then over godets 120 and 130 having successively higher rotational speeds. Drawing occurred predominantly between godet 120 and godet 130 and was facilitated by heating the godets. The drawn yarn was entangled in air jet entangler 140 and then wound onto precision winder 150. The yarn drawing conditions are shown in Table 3.

TABLE 3

| Item | Units | Value |
|---|---|---|
| Godet 110 | Temperature ° C. | Ambient |
| Godet 110 | Surface Speed (fpm) | 500 |
| Godet 120 | Temperature ° C. | 77 |
| Godet 120 | Surface Speed (fpm) | 507 |
| Godet 130 | Temperature ° C. | 160 |
| Godet 130 | Surface Speed (fpm) | 2895 |

Properties of the drawn fiber were measured on an Instron Tensile Tester, Model 1130, equipped with cord and yarn clamps. The initial specimen length was 10 inches and the test was run at 10 inches of extension per minute. The results were as shown in Table 4.

TABLE 4

| Item | Value | Units |
|---|---|---|
| Denier | 64.5 | — |
| Tenacity | 8.73 | g/denier |
| Breaking Elongation | 14.6 | percent |

EXAMPLE 3

Braided Polyester Sutures

The drawn yarn produced in Example 2 was formed into a suture as follows: Yarn samples were plied at 3 turns per inch and then braided on a New England Butt 8 carrier braider (not shown) at 38.6 picks per inch. The braid was then hot stretched in a tunnel between opposed matte surfaced godets numbered (1) and (2) under the conditions shown in Table 5. The braid was stretched 21%.

TABLE 5

| Item | Units | Value |
|---|---|---|
| Godet 1 | Temperature ° C. | 200 |
| Godet 1 | Surface Speed (fpm) | 14 |
| Tunnel | Temperature ° C. | 231 |
| Godet 2 | Temperature ° C. | 200 |
| Godet 2 | Surface Speed (fpm) | 17 |

The stretched braid was softened by treatment in 3% NaOH aqueous solution maintained at 82.2° C. for 30 minutes. The softened braid was then washed and rinsed. The washed braid was then immersed in a solution of 5% silastic rubber and benzoyl peroxide catalyst as actives in a xylene solvent to coat the braid. The silastic rubber-coated braid was next cured in an oven at 170° C. and converted into a suture by attaching a needle, packaging and finally sterilizing with ethylene oxide. The properties of the suture were as in Table 6.

TABLE 6

| Property Measured | Value | Units |
|---|---|---|
| Diameter | 0.315 | mm |
| Denier | 930 | |
| Tenacity[1/] | 7.45 | g/denier |
| Breaking Elongation | 14.0 | percent |
| Knot Pull[2/] | 2.93 | Kg |

[1/]Tenacity was determined by a straight pull of a sample using a 10 inch gauge length and 10 inch per minute crosshead speed. "Cord and yarn" clamps were used for this purpose.
[2/]Knot pull was determined by tying a sample in a "surgeon's knot" around a piece of rubber tubing and testing as in determining tenacity.

The suture was uniformly dyed to a deep coloration, had an excellent feel, did not exhibit "chattering" during use and provided reduced tendency to break during knot tying.

EXAMPLE 4

Extrusion of PET Yarn

Bulk PET, sold as Arnite A06 100 and available from DSM Engineering Plastics, having an intrinsic viscosity of 1.07 (tetrachloroethoxyphenol) was dry blended with 0.075 wt. % of D&C Blue No. 6 and processed as described in Example 1 under the operating parameters shown in Table 7 as follows:

TABLE 7

| Station | Units | Value |
|---|---|---|
| Extrusion Screw | Rotations/Minute | 42 |
| Extrusion Zone 1 | Temperature ° C. | 315 |
| Extrusion Zone 2 | Temperature ° C. | 315 |
| Extrusion Zone 3 | Temperature ° C. | 315 |
| Melt Pump 25 | Temperature ° C. | 289 |
| Melt Pump Size | cc/Revolution | 0.584 |
| Melt Pump Rate | Rotations/Minute | 24.9 |
| Spin Pack Pressure | Pounds/Sq. Inch | 3425 |
| Spinnerette | Number of Holes | 28 |
| Spinnerette Hole Diameter | Mils | 10 |
| Hot Collar 40 | Temperature ° C. | 250 |
| First Godet 70 | Temperature ° C. | Ambient |
| First Godet 70 | Surface Speed (fpm) | 1500 |
| Second Godet 80 | Temperature ° C. | Ambient |
| Second Godet 80 | Surface Speed (fpm) | 1507 |

Fiber was taken up on precision winder 90 as it exited second godet 80. The denier of the yarn at this point was 341.

EXAMPLE 5

Drawing of Extruded Yarn of Example 4

After a lag time of three (3) days, the extruded yarn of Example 4 was drawn as described in Example 2, using the drawing conditions shown in Table 8.

TABLE 8

| Item | Units | Value |
|---|---|---|
| Godet 110 | Temperature ° C. | Ambient |
| Godet 110 | Surface Speed (fpm) | 500 |
| Godet 120 | Temperature ° C. | 77 |
| Godet 120 | Surface Speed (fpm) | 507 |
| Godet 130 | Temperature ° C. | 160 |
| Godet 130 | Surface Speed (fpm) | 2900 |

Drawn fiber was taken up on precision winder 150 as it exited godet 130. The properties of the drawn fiber are shown in Table 9.

TABLE 9

| Item | Value | Units |
|---|---|---|
| Denier | 60.9 | — |
| Tenacity | 8.86 | g/denier |
| Breaking Elongation | 12.7 | percent |

EXAMPLE 6

Braided Polyester Sutures

The drawn yarn produced in Example 5 was converted to a suture as follows: Yarn samples were two plied at 3 turns per inch and then braided on a New England Butt 8 carrier braider. The braid was then hot stretched under the conditions shown in Table 10 to stretch the braid 33%.

TABLE 10

| Item | Units | Value |
|---|---|---|
| Godet 1 | Temperature ° C. | Ambient |
| Godet 1 | Surface Speed (fpm) | 44.8 |
| Tunnel | Temperature ° C. | 254 |
| Godet 2 | Temperature ° C. | 23 |
| Godet 2 | Surface Speed (fpm) | 59.8 |

The stretched braids were softened, coated and converted into sutures as described in Example 3. The properties of the finished sutures are shown in Table

TABLE 11

| Property Measured | Value | Units |
|---|---|---|
| Diameter | 0.335 | mm |
| Denier | 1017 | — |
| Tenacity | 7.1 | g/denier |
| Breaking Elongation | 14.9 | percent |
| Knot Pull | 3.2 | Kg |

The sutures are uniformly dyed to a deep coloration.

EXAMPLE 7

A PET polymer chip with an intrinsic viscosity of 1.04 was dry blended with 0.075% by weight D&C Blue No. 6 in a large plastic bag and the blend dried with desiccated hot air at 155° C. for 8 hours. The blend was extruded on a ¾ inch diameter 20:1 L:D extruder at approximately 2.5 pounds/hour. Extrusion temperature was 310° C. in the barrel and 335° C. at the spinnerette.

A spinnerette with 28 holes, each 0.010 inches in diameter and 0.060 inches long, was used. Throughput was 17.8 cc/minute and take away speed was 2007 feet/minute. A processing finish was applied. The yarn was taken up on a precision winder at less than about 50 grams tension. Yarn properties at this point were:

| | |
|---|---|
| Denier = | 354 |
| Tenacity = | 1.28 gpd |
| Breaking Elongation = | 594% |

The tensile properties were obtained using a constant rate of elongation tester (Instron), equipped with cord and yarn clamps, set with an initial length of 3 inches and stretching at 10 inches per minute.

After a 24 hours hold time at room temperature, the yarn was drawn. Drawing conditions were:

| | | | |
|---|---|---|---|
| Godet 1 fpm: | 500 | Temp (C.): | ambient |
| Godet 2 fpm: | 507 | Temp (C.): | 90 |
| Godet 3 fpm: | 2900 | Temp (C.): | 200 |

An air-jet entangler was used between the third godet and the winder to interlace the yarn to give it cohesion. The drawn/entangled yarn was tested and its properties were:

| | |
|---|---|
| Denier = | 64 |
| Tenacity = | 8.7 gpd |
| Breaking Elongation = | 15% |

The tensile properties were obtained using a constant rate of elongation tester, equipped with cord and yarn clamps, set with an initial gauge length of 10 inches, and stretched at 10 inches per minute.

Yarns were two-plied at 3 turns/inch (tpi) half in the "S" direction, half in the "Z" direction. The two-plied yarns were parallel wound onto braider bobbins in preparation for braiding. Braid was formed on an eight carrier braider. Four carriers travelled clockwise and were loaded with yarns having "Z" twist. Four carriers travelled counter-clockwise and were loaded with yarns having "S" twist. The braided properties were:

| | |
|---|---|
| Denier = | 1101 |
| Straight Pull: tenacity = | 7.3 gpd |
| Surgeon's Knot Pull: tenacity = | 3.3 gpd |
| Breaking Elongation = | 18% |

The braid was washed to remove all processing finish and any contaminants. The washed braid was stretched in a heated chamber to tighten the construction and impart improved properties. The stretching conditions were:

| | |
|---|---|
| Input speed (fpm): | 40 |
| Input roll Temperature (° C.): | 155 |
| Stretching chamber Temperature (° C.): | 234 |
| Output roll speed (fpm) (° C.): | 45.5 |
| Stretching Tension (g): | 2000 |

The stretched braid properties were:

| | |
|---|---|
| Denier = | 1009 |
| Straight pull: tenacity = | 7.3 gpd |
| Surgeon's Knot pull: tenacity = | 3.3 gpd |
| Breaking Elongation = | 17% |

The stretched braid was next softened in a caustic solution, washed and treated with a silicone solution to impart improved handling to the treated braid. The properties at this point were:

| | |
|---|---|
| Denier = | 974 |
| Straight pull: tenacity = | 7.2 gpd |
| Surgeon's Knot pull: tenacity = | 3.1 gpd |
| Breaking Elongation = | 17% |

The braid was converted into suture by attaching a needle, packaging and sterilizing the packages with either ethylene oxide or gamma irradiation.

Other variations and modifications of this invention will be obvious to those skilled in the art. This invention is not limited except as set forth in the following claims.

What is claimed is:

1. Method for forming a dyed braided suture comprising:

(a) dry blending a biocompatible colorant with an extrudable non-bioabsorbable thermoplastic resin to form a uniform blend of said colorant and said resin;

(b) extruding the blend by melt-spinning and cooling to form filaments;

(c) drawing the filaments to increase crystallinity and molecular orientation;

(d) braiding the drawn filaments; and (e) converting the braided filaments into a suture.

2. The method of claim 1 when the colorant is a free-flowing dry powder at room temperature.

3. The method of claim 1 where the colorant is D&C Blue No. 6 having Color Index No. 73000.

4. The method of claim 1, wherein the colorant is present in the blend in amounts up to about 0.2% by weight based on the total weight of the colorant and resin.

5. The method of claim 4, wherein the colorant is present in amounts from about 0.01 to about 0.2% by weight.

6. The method of claim 1, wherein said resin is in pellet, chip or granule form.

7. The method of claim 1, wherein said resin is selected from the group consisting of homo and copolymers of $C_1$–$C_6$ olefins, polyamides and polyesters of difunctional carboxylic acids and diols.

8. The method of claim 7, wherein said resin is polyethylene terephthalate.

9. The method of claim 1, wherein the blend is dried at elevated temperatures with hot air to remove moisture present prior to said extruding step (b).

10. The method of claim 8, wherein the polyethylene terephthalate has an inherent viscosity at least about 0.95.

11. The method of claim 1, wherein the filaments are drawn to from 4 to 6 times the length of the extruded filaments.

12. The method of claim 1, wherein the filaments are drawn to provide an elongation to break less than about 35%.

13. The method of claim 1, including the step of entangling the filaments prior to the step (d) of braiding the filaments.

14. The method of claim 1, including the step of stretching the braided filaments at elevated temperatures from about 6% to 33%.

15. The method of claim 1, including the step of surface etching the braided filaments.

16. The method of claim 1, including the step of matte rolling the surface of the braided filaments.

17. The method of claim 1, wherein the braided filaments are converted into a suture by the steps of attaching a needle, packaging and thereafter sterilizing the suture.

* * * * *